US008524335B2

(12) United States Patent
Prevost

(10) Patent No.: US 8,524,335 B2
(45) Date of Patent: Sep. 3, 2013

(54) METHOD FOR STIFFENING SYNTHETIC RIBBONS OF A SYNTHETIC TURF SURFACE

(75) Inventor: Jean Prevost, Westmount (CA)

(73) Assignee: Tarkett Inc. (CA)

( * ) Notice: Subject to any disclaimer, the term of this patent is extended or adjusted under 35 U.S.C. 154(b) by 524 days.

(21) Appl. No.: 11/917,996

(22) PCT Filed: Jun. 19, 2006

(86) PCT No.: PCT/IB2006/003933

§ 371 (c)(1),
(2), (4) Date: Sep. 29, 2009

(87) PCT Pub. No.: WO2007/069076

PCT Pub. Date: Jun. 21, 2007

(65) Prior Publication Data

US 2010/0015364 A1 Jan. 21, 2010

Related U.S. Application Data

(60) Provisional application No. 60/691,595, filed on Jun. 17, 2005.

(51) Int. Cl.
*A01N 3/00* (2006.01)

(52) U.S. Cl.
USPC ..... 428/17; 428/15; 428/21; 428/91; 428/92

(58) Field of Classification Search
USPC ..... 428/15, 17, 91, 21, 92
See application file for complete search history.

(56) References Cited

U.S. PATENT DOCUMENTS

| | | | | |
|---|---|---|---|---|
| 3,940,522 | A | 2/1976 | Wessells | |
| 3,974,312 | A | 8/1976 | Stevens et al. | |
| 4,340,631 | A | 7/1982 | Endo et al. | |
| 5,601,886 | A | 2/1997 | Ishikawa et al. | |
| 5,887,416 | A | 3/1999 | Shimono et al. | |
| 5,958,527 | A * | 9/1999 | Prevost | 428/17 |
| 6,029,397 | A * | 2/2000 | Motz et al. | 47/58.1 R |
| 6,242,062 | B1 | 6/2001 | De Vries | |
| 6,299,959 | B1 | 10/2001 | Squires et al. | |
| 6,338,885 | B1 | 1/2002 | Prevost | |
| 6,372,310 | B2 | 4/2002 | De Vries | |
| 6,468,622 | B1 | 10/2002 | Combs et al. | |
| 6,491,991 | B2 * | 12/2002 | Seaton | 428/17 |

(Continued)

FOREIGN PATENT DOCUMENTS

| | | |
|---|---|---|
| CA | 1246109 | 12/1988 |
| CA | 2441993 | 9/2002 |

(Continued)

OTHER PUBLICATIONS

European Search Report of EP 06848550, Oct. 2009.

(Continued)

*Primary Examiner* — Cathy Lam
(74) *Attorney, Agent, or Firm* — Factor Intellectual Property Law Group, Ltd.

(57) ABSTRACT

The present invention is directed to a system and method for adjusting the relative stiffness of a synthetic turf system's synthetic ribbons. A stiffening agent is applied to the synthetic turf system such that its synthetic ribbons that are responsive to the stiffening agent will stiffen subsequent to the application of the stiffening agent.

13 Claims, 1 Drawing Sheet

(56) References Cited

U.S. PATENT DOCUMENTS

| | | | | |
|---|---|---|---|---|
| 6,551,689 | B1 | 4/2003 | Prevost | |
| 6,620,482 | B2 | 9/2003 | Carr et al. | |
| 6,673,444 | B2 | 1/2004 | Yuuki et al. | |
| 6,689,447 | B2 * | 2/2004 | Prevost | 428/87 |
| 6,723,412 | B2 | 4/2004 | Prevost | |
| 6,746,752 | B2 | 6/2004 | Prevost | |
| 6,753,049 | B2 * | 6/2004 | De Vries | 428/17 |
| 6,767,595 | B2 | 7/2004 | Prevost et al. | |
| 6,858,272 | B2 | 2/2005 | Squires | |
| 6,946,181 | B2 | 9/2005 | Prevost | |
| 6,955,841 | B2 * | 10/2005 | Weghuis et al. | 428/17 |
| 7,153,553 | B2 | 12/2006 | Tetrault | |
| 7,249,913 | B2 | 7/2007 | Linville | |
| 7,357,966 | B2 | 4/2008 | Dipple et al. | |
| 7,939,144 | B2 * | 5/2011 | Verleyen | 428/17 |

FOREIGN PATENT DOCUMENTS

| | | | |
|---|---|---|---|
| CA | 2436914 | | 12/2002 |
| DE | 3525441 | A1 | 1/1987 |
| EP | 0301843 | A1 | 2/1989 |
| EP | 0381292 | | 8/1990 |
| EP | 0678622 | A1 | 4/1995 |
| EP | 0776762 | A1 | 6/1997 |
| FR | 2719619 | A1 | 11/1995 |
| GB | 2231276 | | 11/1990 |
| JP | 51-57934 | A | 5/1976 |
| JP | 6-158609 | A | 6/1994 |
| JP | 9-100509 | A | 4/1997 |
| JP | H11-93111 | A | 4/1997 |
| JP | 9-217311 | A | 8/1997 |
| JP | 9-273107 | A | 10/1997 |
| JP | 10-204815 | A | 8/1998 |
| JP | H11-93112 | A | 6/1999 |
| JP | 2005-60973 | A | 3/2005 |
| WO | WO 95/09949 | A1 | 4/1995 |
| WO | WO 98/40559 | | 9/1998 |
| WO | WO 98/55697 | | 12/1998 |
| WO | WO 01/48322 | A1 | 7/2001 |
| WO | WO 01/61110 | A1 | 8/2001 |
| WO | WO 2004/077914 | A2 | 9/2004 |
| WO | WO 2005/005731 | A2 | 1/2005 |
| WO | WO 2004/106601 | A1 | 12/2005 |
| WO | WO 2006/085751 | | 8/2006 |

OTHER PUBLICATIONS

U.S. Publication No. 2004/0229007, published Nov. 18, 2004 by Motz et al.

U.S. Publication No. 2006/0107880, published May 25, 2006 by Peeples.

U.S. Publication No. 2008/0124496, published May 29, 2008 by Avery.

U.S. Publication No. 2008/0125237, published May 29, 2008 by Avery.

U.S. Publication No. 2006/0216458, published Sep. 28, 2006 by Gilman et al.

U.S. Publication No. 2009/0041956, published Feb. 12, 2009 by Gilman et al.

European Search Report of EP 05025310, Mar. 2006.

Installation Specification by Greenfields B.V. in The Netherlands, dated Jun. 16, 2003.

Installation Specification by Greenfields B.V. in The Netherlands, dated Sep. 30, 2005.

Opposition Against European Patent No. 1707291 filed Dec. 24, 2008.

Opposition Against European Patent No. 1707291 filed Dec. 29, 2008.

U.S. Publication No. 2003/009978, published May 29, 2003 by Fink.

* cited by examiner

METHOD FOR STIFFENING SYNTHETIC RIBBONS OF A SYNTHETIC TURF SURFACE

RELATED APPLICATIONS

This application claims benefit to the filing date of U.S. Provisional Patent Application Ser. No. 60/691,595, filed on Jun. 17, 2005; the contents of which are incorporated herein by reference. This application is also related to U.S. Pat. Nos. 6,338,885, 6,723,412, and U.S. patent application Ser. No. 11/273,584, filed Nov. 14, 2005, entitled "Synthetic Turf System Having an Infill Trapping Structure," the contents of all of which are incorporated herein.

TECHNICAL FIELD

The present invention is related to synthetic turf systems, and more particularly, to a system and method for altering the stiffness of the synthetic ribbons or fibers incorporated with the synthetic turf system.

BACKGROUND OF THE INVENTION

Synthetic turf systems have been used for some sports traditionally played on natural turf, or grass. Natural grass surfaces tend not to stand up well to wear and generally require a great deal of maintenance. Also, the grass of the natural turf surface typically does not grow well in partly or fully enclosed sports stadiums. Overall, synthetic grass surfaces stand up to wear much better than the natural grass surfaces, do not require as much maintenance, and can be used in closed stadiums.

Some synthetic grass surfaces comprise rows of strips, ribbons, or fibers of synthetic material extending vertically from a backing mat with a particulate material—infill or infill layer—located between the ribbons and above the mat. The infill material assists in supporting the synthetic ribbons in a generally upright orientation. In addition, the infill may contribute to the resiliency of the synthetic turf system and aid in its overall drainage. Commonly used components for the infill includes hard particulate matter, e.g., sand; soft particulate matter, e.g., rubber; and, various combinations thereof. In applications requiring additional drainage or resiliency, the backing mat may be placed over a drainage tile or resilient pad, respectively.

The synthetic fibers represent blades of grass that are relatively soft and non-abrasive and are typically constructed of polypropylene or polyethylene. A portion of the synthetic ribbons extends a predetermined distance above the infill layer of particulate material and provides the synthetic turf system with a more grass-like appearance. The exposed ends of the synthetic ribbons can also provide a desired amount of friction to, among other things, a rolling ball used in baseball, soccer, lacrosse, etc. In some situations when the exposed ends of the synthetic fibers are bent or folded over, the coefficient of friction of the synthetic fiber relative to the rolling ball is reduced, and thus the ball will roll at a speed that may be relatively faster than that expected when rolling over a natural grass surface.

After the installation or use of a playing surface comprising a synthetic turf system, it is not uncommon to find a portion—perhaps a significant portion—of exposed synthetic ribbons to be bent or folded over instead of remaining relatively upright. Although folded or bent synthetic ribbons may not be objectionable for use in some events, there are other events such as high-level soccer where it would be undesirable.

Earlier designs of synthetic turf systems have focused on providing synthetic ribbons having a desired length, rigidity, and spacing for a particular sporting event. As such, the playing surface was not adaptable to other events having dissimilar playing characteristics. Depending on the desired playing characteristics for a sporting event, the corresponding physical characteristics of the associated synthetic ribbons may be different. For instance, it may be preferable in one sport as compared to another sport for the ball to roll over the synthetic grass surface at a faster or slower speed. As such, it would be beneficial if the physical characteristics of the synthetic ribbons could be adjusted depending upon the desired playing characteristics of the sporting event or the playing level of the participants. Thus, instead of the synthetic ribbon having a "fixed" amount of rigidity and relative friction, these characteristics could be altered. In situations where different events are held on the playing surface, some of the events may reluctantly be played on a synthetic turf surface that may have less than optimal playing characteristics for that particular sporting event.

Accordingly, the present invention is directed to a novel method of altering the physical characteristics of a synthetic playing surface dependent upon the desired playing characteristics of the event. In particular, the present invention is directed to stiffening at least a portion of the exposed ends of the synthetic fibers, when desired, so that the stiffened ends stay in a relatively upright orientation for a predetermined period of time.

The present invention is provided to address these and other considerations.

SUMMARY OF THE INVENTION

The present invention is directed to a synthetic turf system including a synthetic turf surface comprising a plurality of synthetic ribbons operatively attached to a backing mat; and provides a method involving grooming the synthetic turf surface, and applying a stiffening agent to the synthetic turf surface. The initial stiffness of the synthetic ribbons will increase upon application of the stiffening agent.

In one aspect of the present invention, the synthetic ribbon may comprise polypropylene or polyethylene and the stiffening agent may comprise diethylene glycol monobutyl ether and acrylic. The stiffening agent can be water soluble or insoluble.

According to another aspect of the present invention, a synthetic turf system comprises a backing mat, a first and second synthetic ribbon attached to the backing mat, and a stiffening agent capable of being operatively attached to the first synthetic ribbon and incapable of being operatively attached to the second synthetic ribbon. As such, upon application of the stiffening agent, only the stiffness of the first synthetic ribbon will be increased.

Other advantages and aspects of the present invention will become apparent upon reading the following description of the drawings and detailed description of the invention.

DETAILED DESCRIPTION

Figure 1:
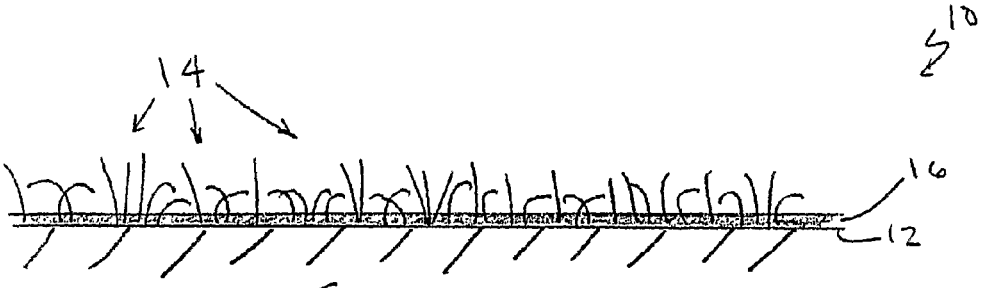
FIG. 1 is a cross-sectional view of a synthetic turf system of the present invention depicting portions of the synthetic ribbons prior to application of a stiffening agent thereto.

While the present invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a method of altering the physical characteristics of a synthetic turf system 10. Referring to FIG. 1, the synthetic turf system 10 generally includes a synthetic turf surface having a backing mat 12 and a plurality of synthetic fibers or ribbons 14. The synthetic turf surface 10 may further include an infill layer 16 positioned above the backing mat 12 and amongst the synthetic ribbons 14. The infill layer 16 comprises a layer of particulate matter. The particulate matter can include any type of infill material, including, and not limited to, hard particles such as sand, soft particles such as rubber, or various combinations of hard and soft particles.

The synthetic ribbons 14 are operatively attached to the backing mat 12 using any one of the techniques known to one of ordinary skill in the art, e.g., gluing, stitching, heat-melting, etc. Portions of the synthetic fibers 14 extend above the infill layer 16 and are thus exposed to represent blades of grass.

Figure 2:
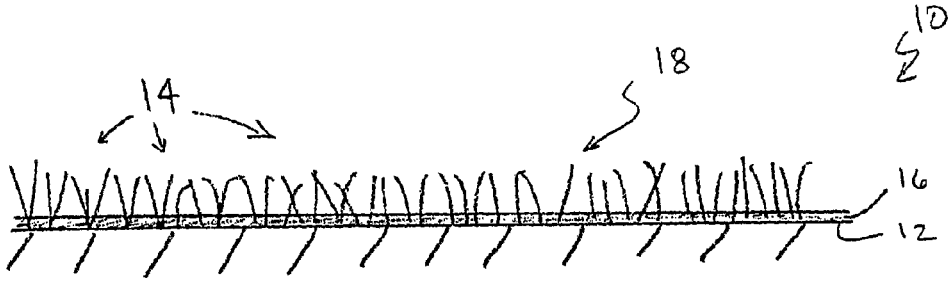
FIG. 2 is a cross-sectional view of the synthetic turf system of FIG. 1 subsequent to the application of a stiffening agent thereto.

In one embodiment of the present invention, the exposed ends of synthetic ribbons 14 are groomed using a brush or the like to stand the exposed ends in a relatively upright orientation. A stiffening agent 18 is applied to the exposed synthetic fibers 14 and ultimately dries and adheres to the synthetic fibers. Preferably, the stiffening agent 18 is sprayed onto the synthetic ribbons 14; however, it is to be understood that other types of application techniques known to one of ordinary skill in the art may be used to facilitate application of the stiffening agent 18 to the synthetic ribbons 14, e.g., brushing. As shown in FIG. 2, once the stiffening agent 18 is dry—via naturally drying or air-blown drying—the exposed portions of the synthetic ribbons 14 stiffen into a generally upright position.

In the preferred embodiment, the stiffening agent 18 comprises diethylene glycol monobutyl ether, acrylic resin, methonal, and texanol and further includes a pH level of approximately 6-8. A commercial product known as V-Restore is a stiffening agent provided by Coatings Specialist Group that is capable of use with the present invention.

It is contemplated by the present invention that any type of stiffening agent capable of being operatively applied and adhered to the synthetic turf system can be utilized to stiffen the synthetic ribbons. It is further considered that one of ordinary skill in the art also appreciates that the application and amount of such stiffening agents will provide varying levels of increased rigidity of the synthetic ribbons, and yet guard against the degradation of the synthetic ribbon by becoming inflexible, brittle, and therefore susceptible to breaking. As such, in consideration of the preferred level of ribbon rigidity sought in view of the desired playing characteristics of the sporting event, one can readily determine the amount of stiffening agent to be applied to the synthetic ribbons.

The stiffening agent can be colored, colorless, and water soluble or insoluble. The use of a water soluble stiffening agent 18 provides the ability to adapt and adjust the playing characteristics of the synthetic turf system relative to rigidity and the corresponding coefficient of friction of the synthetic ribbons 14. That is, the water soluble stiffening agent 18 can be applied to the synthetic ribbons 14 to stiffen the ribbons for use in one playing event; and then the stiffening agent can be removed via water rinsing to return the synthetic ribbons to their pre-stiffened state for use in another playing event.

In another embodiment of the present invention, a portion of the synthetic ribbons (designated by reference 15) will not permit the stiffening agent 18 to be adhered thereto. That is, the stiffening agent 18 will only adhere to, and thus stiffen, a predetermined portion of the synthetic ribbons 14. As such, the synthetic playing surface can be designed such that its overall rigidity or friction with respect to the objects used in the event, e.g., ball, stick, shoes; can be altered depending upon the desired playing characteristics of the synthetic surface and the type and amount of synthetic ribbons.

Figure 3:
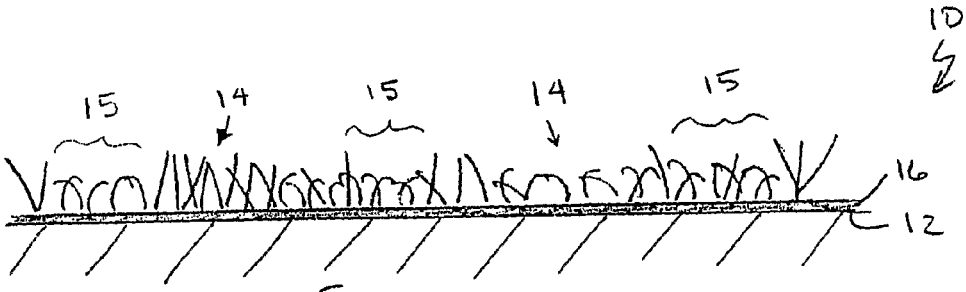
FIG. 3 is a cross-sectional view of a synthetic turf system of another embodiment of the present invention prior to the application of a stiffening agent thereto, wherein the synthetic turf system comprises a first synthetic ribbon being responsive to a stiffening agent and a second synthetic ribbon being non-responsive to a stiffening agent; and, FIG. 4 is a cross-sectional view of the synthetic turf system of FIG. 3 subsequent to the application of the stiffening agent thereto.
Figure 4:
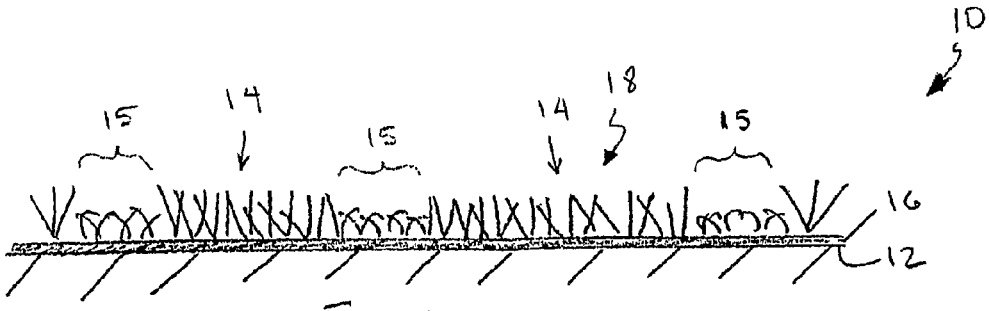

Referring now to FIGS. 3 and 4, the synthetic playing surface having partially responsive synthetic ribbons includes a first 14 and second 15 synthetic ribbon operatively attached to the backing mat 12. Only the first synthetic ribbon 14 is comprised of cooperative material such that it is responsive to the stiffening agent 18 upon application to the first synthetic ribbon; but the composition of the second synthetic ribbon 15 is not cooperative or responsive with the stiffening agent and thus its rigidity will not be altered upon application of the stiffening agent. Upon application and subsequent drying of the stiffening agent 18 to the synthetic turf surface, only the first synthetic ribbon 14 will stiffen and the second synthetic ribbon 15 will not.

As described above, the present invention provides for a synthetic playing surface with the capability of being constructed in view of its intended usage and desired playing characteristics; and thus includes a variety of configurations of the first 14 and the second 15 synthetic ribbons. For example, in some synthetic turf system applications it may be desirable to have a sufficient amount of folded synthetic ribbons to assist in retarding the displacement of the infill particles, e.g., infill splash; while in other applications, it may be desirable to have a sufficient amount of generally upright synthetic ribbons to provide adequate resistant to a rolling ball; and in other applications, it may be beneficial to have "slower" or "faster" segments of the playing surface.

While specific embodiments of the present invention have been illustrated and described, numerous modifications come to mind without significantly departing from the spirit of the invention, and the scope of protection is only limited by the scope of the accompanying claims.

I claim:

1. For a synthetic turf system including a synthetic turf surface comprising a plurality of synthetic ribbons operatively attached to a backing mat, a method comprising the steps of:

grooming a synthetic turf surface; and, applying a stiffening agent to the synthetic turf surface, wherein the stiffening agent comprises diethylene glycol monobutyl ether;

wherein the synthetic turf surface further includes an infill layer of particulate material atop the backing mat and dispersed among the plurality of synthetic ribbons such that portions of the synthetic ribbons extend above the infill layer, each of the plurality of synthetic ribbons having an initial stiffness that will increase upon application of the stiffening agent.

2. The method of claim 1 wherein the stiffening agent is water soluble.

3. The method of claim 1 wherein the stiffening agent comprises an acrylic.

4. The method of claim 1 further comprising: air drying the stiffening agent after applying the stiffening agent.

5. For a synthetic turf system including a synthetic turf surface comprising a plurality of synthetic ribbons operatively attached to a backing mat, a method comprising the steps of:

providing a synthetic turf surface having an infill layer of particulate material and a plurality of synthetic ribbons including a first synthetic ribbon being responsive to a stiffening agent and a second synthetic ribbon being non-responsive to the stiffening agent;

grooming the synthetic turf surface; and, applying a stiffening agent to the synthetic turf surface, and wherein the stiffening agent comprises diethylene glycol monobutyl ether.

6. The method of claim 5 wherein the stiffening agent comprises an acrylic.

7. The method of claim 5 wherein the stiffening agent is water soluble.

8. The method of claim 5 further comprising: air drying the stiffening agent after applying the stiffening agent.

9. A synthetic turf system comprising:

a backing mat;

a first synthetic ribbon being operatively attached to the backing mat;

a second synthetic ribbon being operatively attached to the backing mat; and, a stiffening agent capable of being operatively attached to the first synthetic ribbon and incapable of being operatively attached to the second synthetic ribbon; and, an infill layer of particulate material, and, wherein the first synthetic ribbon comprises polypropylene or polyethylene and the stiffening agent comprises diethylene glycol monobutyl ether.

10. The synthetic turf system of claim 9 wherein the stiffening agent comprises an acrylic.

11. The synthetic turf system of claim 9 wherein the stiffening agent is water soluble.

12. The synthetic turf system of claim 9 wherein the stiffening agent is water insoluble.

13. The synthetic turf system of claim 9 wherein the stiffening agent has a pH level of approximately 6-8.

* * * * *